US006000057A

United States Patent [19]

Newman

[11] Patent Number: 6,000,057

[45] Date of Patent: Dec. 14, 1999

[54] ODOR PREVENTING HUNTING APPAREL

[76] Inventor: Anthony E. Newman, 2340 Horizon Cir., Shakopee, Minn. 55379

[21] Appl. No.: 09/014,758

[22] Filed: Jan. 28, 1998

Related U.S. Application Data

[60] Provisional application No. 60/054,732, Aug. 4, 1997.

[51] Int. Cl.[6] ..... A41B 1/00

[52] U.S. Cl. ..... 2/69; 2/115; 2/243.1

[58] Field of Search ..... 2/69, 243.1, 1, 2/79, 272, 108, 84, 901, 115, 400–408, 113, 114

[56] References Cited

U.S. PATENT DOCUMENTS 5,856,005 1/1999 Gurian ..... 428/370

*Primary Examiner*—Gloria Hale
*Attorney, Agent, or Firm*—Michael S. Sherrill

[57] ABSTRACT

Hunting apparel constructed from antimicrobial fabrics and methods of making and using such hunting apparel.

12 Claims, 1 Drawing Sheet

ODOR PREVENTING HUNTING APPAREL

This is a nonprovisional of provisional application Ser. No. 60/054,732 Aug. 4, 1997.

FIELD OF THE INVENTION

The invention relates to hunting clothes and fabric used in the construction of hunting clothes.

BACKGROUND

Hunters go to great lengths to mask or reduce the emanation of odors when hunting big game. Many animals have a well developed sense of smell and are thereby able to avoid predators, such as hunters.

While a number of different products have been developed in an effort to mask or reduce odors emitted by hunters, from urine-based animal scents to body-suits containing activated charcoal, a substantial need continues to exist for a safe, simple, comfortable and cost effective means of reducing the emanation of body odors.

SUMMARY OF THE INVENTION

The invention is directed to clothing constructed from anti-microbial fabrics.

DETAILED DESCRIPTION OF THE INVENTION INCLUDING A BEST MODE

Figure 1:
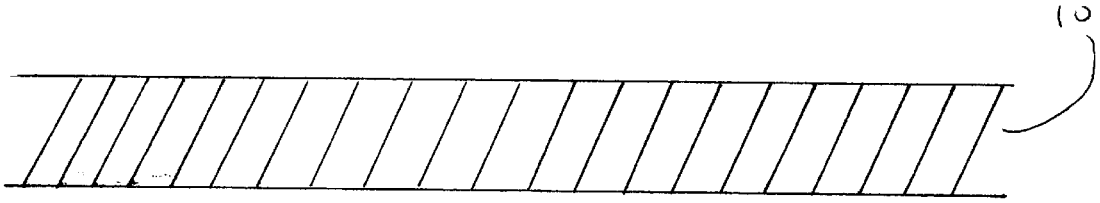
FIG. 1 is an enlarged cross-sectional view of a first embodiment of the invention.
Figure 2:
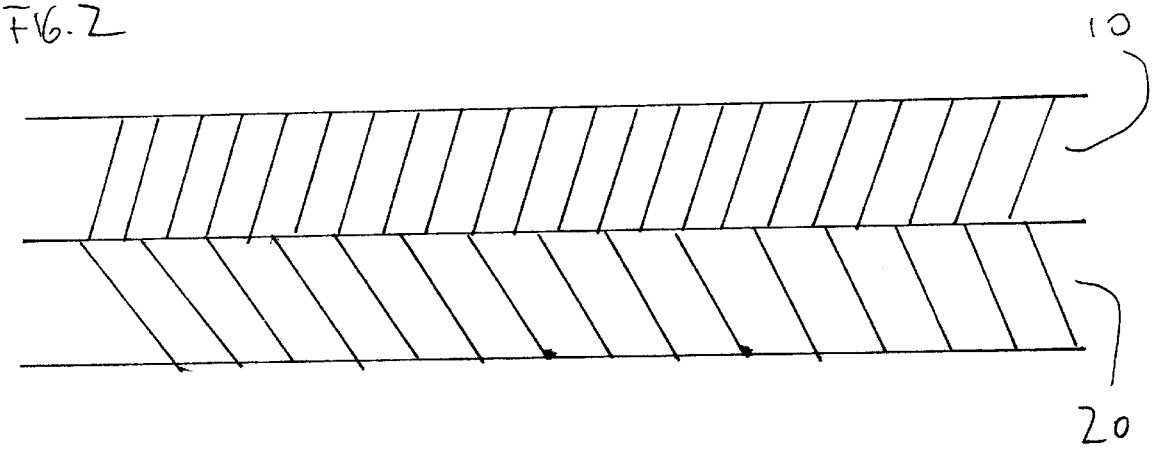
FIG. 2 is is an enlarged cross-sectional view of a second embodiment of the invention.

The invention represents a safe, simple, comfortable and cost effective means of concealing a hunter from the olfactory senses of big game, such as bear, deer, elk, fox, etc., by reducing the bacteria population on the body of the hunter, specifically in the axillary areas. It is believed by many experts that as much as 80 to 90% of the odor emanating from the human body is produced by otherwise benign bacteria that inhabit the axillary areas of the body. I have discovered that the body odor generated by a hunter can be significantly reduced for at least the duration of a normal hunting outing (i.e., from several hours to a few days), by wearing clothing capable of inhibiting the growth and reproduction of odor-producing bacteria on the body.

The invention is directed to the use of antimicrobial fabrics in the construction of hunting clothing, preferably undergarments such as T-shirts, briefs, socks, thermal underwear, gloves, hats, scarves, etc. having directed and intimate contact with the skin.

Antimicrobial fabrics 10 are available from a number of sources including Sherman Textile Company of Dallas, N.C.; Magna Fabrics of North Bergen, N.J.; and Microban Products Company of Huntersville, N.C. A preferred family of antimicrobial fabrics are the fabrics available from the Microban Products Company under the Microban® mark, such as Microsafe® fabric.

The clothing is effective for preventing the growth and reproduction of odor-producing bacteria on the body, and thereby reducing body odor, by simply wearing the antimicrobial clothing such item of clothing would normally be worn. It is generally preferred to put on the antimicrobial clothing shortly after showering, preferably with an odor-neutralizing soap of the type commonly available from those retail outlets which sell hunting supplies, as antimicrobial clothing is not effective for masking or absorbing those odors already present on the body. For those situations where odor absorption is also desired, the clothing can be fabricated with an outer layer an odor absorbing material 20, such as activated charcoal.

I claim:

1. Hunting apparel comprising an article of clothing constructed with an inner layer of an antimicrobial fabric and outer layer of an odor absorbing material.

2. The hunting apparel of claim 1 wherein the article of clothing is selected from the group consisting of briefs, gloves, socks, thermal underwear, and T-shirts.

3. Hunting apparel comprising an article of clothing having an inner layer impregnated with an antimicrobial effective for retarding the growth and reproduction of odor-producing bacteria on a human body, and an outer layer of an odor absorbing material.

4. The hunting apparel of claim 3 wherein the article of clothing is selected from the group consisting of briefs, gloves, socks, thermal underwear, and T-shirts.

5. A method comprising:

(a) donning at least one article of clothing constructed from an antimicrobial fabric, and then (b) hunting big game while wearing the article of clothing constructed from an antimicrobial fabric.

6. The method of claim 5 further comprising the initial step of bathing, followed shortly thereafter by donning of the article of clothing constructed from an antimicrobial fabric whereby the growth and reproduction of odor-producing bacteria subsequent to bathing is limited.

7. The method of claim 6 wherein bathing is effected with an odor neutralizing soap.

8. The method of claim 5 further comprising the step of donning at least one odor-absorbing article of clothing over the article of clothing constructed from an antimicrobial fabric.

9. A method comprising:

(a) donning at least one article of clothing impregnated with an antimicrobial effective for retarding the growth and reproduction of odor-producing bacteria on a human body, and then (b) hunting big game while wearing the antimicrobial impregnated article of clothing.

10. The method of claim 9 further comprising the initial step of bathing, followed shortly thereafter by donning of the antimicrobial impregnated article of clothing whereby the growth and reproduction of odor-producing bacteria subsequent to bathing is limited.

11. The method of claim 10 wherein bathing is effected with an odor neutralizing soap.

12. The method of claim 9 further comprising the step of donning at least one odor-absorbing article of clothing over the antimicrobial impregnated article of clothing.

* * * * *